US005459026A

United States Patent [19]

Nakamura et al.

[11] Patent Number: 5,459,026

[45] Date of Patent: Oct. 17, 1995

[54] SILVER HALIDE PHOTOGRAPHIC MATERIAL

[75] Inventors: Tetsuo Nakamura; Junichiro Hosokawa, both of Kanagawa, Japan

[73] Assignee: Fuji Photo Film Co., Ltd., Kanagawa, Japan

[21] Appl. No.: 310,741

[22] Filed: Sep. 22, 1994

[30] Foreign Application Priority Data

Sep. 24, 1993 [JP] Japan ..... 5-238004

[51] Int. Cl.[6] ..... G03C 1/005; G03C 1/494

[52] U.S. Cl. ..... 430/587; 430/510; 430/517; 430/522

[58] Field of Search ..... 430/510, 517, 430/522, 587

[56] References Cited

U.S. PATENT DOCUMENTS 5,296,344 3/1994 Jimbo et al. ..... 430/522

FOREIGN PATENT DOCUMENTS 3192157 8/1991 Japan .
4362634 12/1992 Japan .
586056 4/1993 Japan .

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide photographic material comprising at least one compound represented by formula (1)

(1)

wherein A represents an acidic nucleus; $L^1$, $L^2$ and $L^3$ each represents a methine group; n represents 0 or 1; $R^3$ represents an alkyl group containing a phosphonate as a substituent; and $R^2$, $R^4$, $R^5$, $R^6$ and $R^7$ each represents a hydrogen atom, an alkyl group, an aryl group, a heterocyclic group, $—OR^{11}$, $—NR^{11}R^{12}$, $—NHCOR^{11}$, $—NHSO_2R^{11}$, $—COOR^{11}$, $—CONR^{11}R^{12}$, $—SO_2NR^{11}R^{12}$, a cyano group or a halogen atom, wherein $R^{11}$ and $R^{12}$ each represents a hydrogen atom, an alkyl group, an aryl group or a heterocyclic group, and may combine together to form a 5- or 6-membered ring.

15 Claims, No Drawings

SILVER HALIDE PHOTOGRAPHIC MATERIAL

FIELD OF THE INVENTION

The present invention relates to a silver halide photographic material having a dyed layer, and more particularly to a silver halide photographic material having a hydrophilic colloidal layer containing a dye which is photochemically inactive and easily decolorized and/or eluted by photographic processing.

BACKGROUND OF THE INVENTION

In a silver halide photographic material, a photographic emulsion layer and another hydrophilic layer are frequently colored for the purpose of allowing them to absorb light within a particular wavelength region.

When it is necessary to control spectral composition of light to enter a photographic emulsion layer, a colored layer is usually formed on the side farther apart from a support than the photographic emulsion layer. Such a colored layer is called a filter layer. When the photographic material has a plurality of photographic emulsion layers, the filter layer is sometimes located therebetween.

For the purpose of preventing blurs of images, namely halation, caused by that light scattered on passage through the photographic emulsion layer or after passage therethrough is reflected from the interface of the emulsion layer and the support or from a surface of the photographic material on the side opposite to the emulsion layer, followed by entering the photographic emulsion layer again, a colored layer called an antihalation layer is provided between the photographic emulsion layer and the support, or on a surface of the support on the side opposite to the photographic emulsion layer. When the photographic material has a plurality of photographic emulsion layers, the antihalation layer is sometimes located therebetween.

In order to prevent a reduction in image sharpness due to scattering of light in the photographic emulsion layer (this phenomenon is generally called "irradiation"), the photographic emulsion layer is colored in some cases.

These hydrophilic colloidal layers to be colored are generally allowed to contain dyes. It is necessary for the dyes to meet the following requirements:

(1) They have proper spectral absorption depending upon their purpose of use;

(2) They are photochemically inactive. Namely, they have no adverse effects on the properties of the silver halide photographic emulsion layers in the chemical sense, such as a reduction in sensitivity, latent image fading and fogging;

(3) They are decolorized during photographic processing stages, or eluted in processing solutions or washing water to leave no harmful coloring in the photographic materials after processing;

(4) They do not diffuse from dyed layers to other layers; and (5) They are excellent in stability with time in solutions or photographic materials, and are not faded.

In particular, when the colored layer is the filter layer, or the antihalation layer located on the same side of the support as the photographic emulsion layer, this layer is required to be selectively colored and to exert no substantial coloring on other layers in many cases. If is not so, not only the harmful spectral effect is exerted on the other layers, but also the effect of the filter layer or the antihalation layer itself is decreased. However, when dye-containing layers come in contact with other hydrophilic layers in a wet state, partial dye diffusion from the former to the latter frequently takes place. In order to prevent such dye diffusion, many efforts have previously been made.

Dyes for attaining the above-described object, in each of which an acidic nucleus is linked to a 5-membered heterocyclic ring by a methine chain, are described in JP-A-54-118247 (the term "JP-A" as used herein means an "unexamined published Japanese patent application"), JP-A-55-155351, JP-A-62-242933, JP-A-1-196040, JP-A-1-196041, JP-A-2-165135, JP-A-2-168250, JP-A-3-144438, JP-A-3-167546, JP-B-60-662 (the term "JP-B" as used herein means an "examined Japanese patent publication"), JP-B-48-42175, U.S. Pat. Nos. 2,622,980 and 3,441,563.

The dyes described in the above-mentioned patents are mainly intended to be added to photographic materials in the form of water-soluble compounds or fine solid particle dispersions, and are difficult to be added to the photographic materials in the form of oil compositions or polymer compositions.

For example, when the compound described in JP-A-3-167546 is added as an oil composition, the solubility of the dye in the oil is too low to obtain a desired optical density, and the rough surface is generated.

In particular, when dyes are used in filter layers which require sharp absorption, it is desirable that they are added as oil compositions or polymer compositions to photographic materials. When the dyes are added as fine solid particle dispersions to the photographic materials, it is difficult to control the absorption wavelength and the waveform.

On the other hand, methine compounds having isoxazolone nuclei and indole nuclei are described in *Angew. Chem.*, 90, 643 (1978). However, only the use thereof as synthetic intermediates is described therein. Further, the use of compounds having isoxazolone nuclei and pyrrole nuclei (or indole nuclei) as dyes for photography is described in JP-A-4-362634.

Furthermore, methine compounds having pyrazolone nuclei and indole nuclei are described in JP-A-3-192157 (corresponding to EP 0434026) and JP-A-5-86056 (corresponding to U.S. Pat. No. 5,296,344).

However, the use of these compounds has inevitably raised the problems that the compounds precipitate from dispersions in which the compounds are dispersed by emulsification to deteriorate the surface state in coating, and that an increase in the amount of oils or polymers causes the lowered strength of coated films and increased stains after processing, because of their insufficient solubility in the oils or the polymers.

SUMMARY OF THE INVENTION

An object of the present invention is to provide a photographic material containing a compound as an oil composition or a polymer composition, the compound having high solubility in an oil or a polymer and not precipitating from an emulsified dispersion high in concentration.

Another object of the present invention is to provide a photographic material containing a compound as an oil composition or a polymer composition, said compound exerting no chemical adverse effect on a photographic emulsion, dying only a particular layer of the photographic material and not diffusing to another layer, and being rapidly decolorized and/or eluted in processing not to be left in the photographic material.

DETAILED DESCRIPTION OF THE INVENTION

As a result of various studies, it was discovered that these objects of the present invention were attained by the following silver halide photographic materials (1) to (4):

(1) A silver halide photographic material comprising at least one compound represented by formula (1)

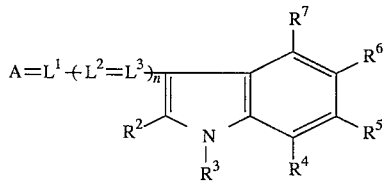

(1)

wherein A represents an acidic nucleus; $L^1$, $L^2$ and $L^3$ each represents a methine group; n represents 0 or 1; $R^3$ represents an alkyl group containing a phosphonate as a substituent; and $R^2$, $R^4$, $R^5$, $R^6$ and $R^7$ each represents a hydrogen atom, an alkyl group, an aryl group, a heterocyclic group, $—OR^{11}$, $—NR^{11}R^{12}$, $—NHCOR^{11}$, $—NHSO_2R^{11}$, $—COOR^{11}$, $—CONR^{11}R^{12}$, $—SO_2NR^{11}R^{12}$, a cyano group or a halogen atom, wherein $R^{11}$ and $R^{12}$ each represents a hydrogen atom, an alkyl group, an aryl group or a heterocyclic group, and may combine together to form a 5- or 6-membered ring;

(2) The silver halide photographic material of (1), wherein the compound represented by formula (1) is a compound represented by formula (2)

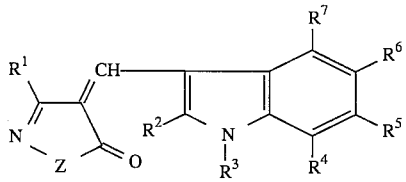

(2)

wherein $R^1$ represents a phenyl group substituted by a substituent having a dissociative proton; Z represents an oxygen atom or $—NR^{14}—$; $R^2$, $R^3$, $R^4$, $R^5$, $R^6$ and $R^7$ each has the same meaning as given in formula (1); and $R^{14}$ represents a hydrogen atom, an alkyl group, an aryl group or a heterocyclic group;

(3) The silver halide photographic material of (1), which comprises a hydrophilic colloidal layer containing at least one compound represented by formula (1) as an oil composition and/or a polymer composition; and (4) The silver halide photographic material of (3), which is a silver halide color photographic material, wherein the hydrophilic colloidal layer is a yellow filter layer.

The compounds represented by formula (1) will be described in detail below.

The acidic nucleus represented by A in the present invention means a cyclic or chain active methylene group, and is preferably a cyclic ketomethylene group or a ketomethylene group substituted by an electron withdrawing group. The acidic nuclei represented by A include 5-pyrazolone, isoxazolone, barbituric acid, thiobarbituric acid, rhodanine, hydantoin, thiohydantoin, oxazolidinedione, pyrazolidinedione, indandione, hydroxypyridone, pyrazolopyridone, 1,2,3,4-tetrahydroquinoline-2,4-dione, 3-oxo-2,3-dihydrobenzo[d]-thiophene-1,1-dioxide, malononitrile, benzoylacetonitrile, cyanoacetanilide and cyanoacetates. 5-Pyrazolone and isoxazolone are particularly preferred.

The methine group represented by $L^1$, $L^2$ or $L^3$ may have a substituent (for example, methyl, ethyl, cyano or chlorine). However, it is preferred that the methine group is unsubstituted. n is preferably 0.

The alkyl group represented by $R^3$ contains a phosphonate as a substituent, and the phosphonate used herein refers to $—P(=O)(OR^8)(OR^9)$, wherein $R^8$ and $R^9$ each represents a hydrogen atom, an alkyl group or an aryl group, which may be the same or different, with the proviso that $R^8$ and $R^9$ are not hydrogen atoms at the same time.

Examples of the alkyl moiety in the alkyl group containing a phosphonate represented by $R^3$ include alkyl groups having 1 to 6 carbon atoms (for example, methyl, ethyl, propyl, butyl and hexyl), preferably alkyl groups having 1 to 3 carbon atoms (methyl, ethyl, propyl and isopropyl), especially preferably an alkyl group having 2 carbon atoms (ethyl).

Preferred examples of the alkyl groups represented by $R^8$ and $R^9$ include alkyl groups each having 1 to 8 carbon atoms (for example, methyl, ethyl, propyl and butyl), and preferred examples of the aryl groups include aryl groups each having 6 to 10 carbon atoms (for example, phenyl and naphthyl). Each may have a substituent (for example, alkyl, aryl, cyano, nitro, hydroxyl, alkoxyl, aryloxy, alkoxycarbonyl, aryloxycarbonyl, acyl, acyloxy, amino, carbonamido, sulfonamido, carbamoyl, sulfamoyl or ureido). It is particularly preferred that $R^8$ and $R^9$ are both methyl or ethyl.

The phosphonate is preferably substituted on a carbon atom adjacent to a carbon atom of $R^3$ bound to the nitrogen atom. Particularly preferred examples of $R^3$ include 2-(dimethylphosphono)ethyl and 2-(diethylphosphono)ethyl. The alkyl group of $R^3$ may have a substituent other than the phosphonate (for example, aryl, cyano, nitro, hydroxyl, alkoxyl, aryloxy, alkoxycarbonyl, aryloxycarbonyl, acyl, acyloxy, amino, carbonamido, sulfonamido, carbamoyl, sulfamoyl or ureido), and the phosphonate may be bound to the alkyl group of $R^3$ through any connecting group (for example, alkoxycarbonyl). For example, 2-{2-(diethylphosphono)ethoxycarbonyl}ethyl is preferably used.

Preferred examples of the alkyl groups represented by $R^2$, $R^4$, $R^5$, $R^6$ and $R^7$ include straight chain, branched chain or cyclic alkyl groups each having 1 to 8 carbon atoms (for example, methyl, ethyl, propyl, butyl, isobutyl, sec-butyl, tert-butyl, cyclohexyl and octyl), each of which may have a substituent. Preferred examples of the substituents include aryl, cyano, nitro, hydroxyl, alkoxyl, aryloxy, alkoxycarbonyl, aryloxycarbonyl, acyl, acyloxy, amino, carbonamido, sulfonamido, carbamoyl, sulfamoyl and ureido.

Preferred examples of the aryl groups represented by $R^2$, $R^4$, $R^5$, $R^6$, $R^7$m $R^{11}$ and $R^{12}$ include aryl groups each having 6 to 18 carbon atoms (for examples, phenyl and naphthyl), each of which may have a substituent. Preferred examples of the substituents include straight chain, branched chain or cyclic alkyl groups, in addition to the same substituents as with the above-described alkyl groups.

The heterocyclic groups represented by $R^2$, $R^4$, $R^5$, $R^6$, $R^7$, $R^{11}$ and $R^{12}$ are saturated or unsaturated 5 to 7-membered $C_{1-6}$ cyclic groups each having 1 to 6 hetero atoms such as O, S, N and Se, provided that the heterocyclic rings may be condensed rings formed by 2 or more rings. Of them, 5- or 6-membered ring is preferred.

Preferred examples of the heterocyclic groups represented by $R^2$, $R^4$, $R^5$, $R^6$, $R^7$, $R^{11}$ and $R^{12}$ include, pyridyl, oxazolyl, thiazolyl, imidazolyl, furyl, pyrrolyl, thienyl, pyrazolyl, pyradinyl, pyrimidinyl, pyridazinyl, pyrrolidinyl, piperidyl, morpholinyl, sulfolanyl and quinolyl, which may have the same substituents as with the above described aryl groups.

The halogen atoms represented by $R^2$, $R^4$, $R^5$, $R^6$ and $R^7$ are preferably fluorine, chlorine, bromine and iodine.

Of the compounds represented by formula (1), compounds in which $R^2$, $R^4$, $R^5$, $R^6$ and $R^7$ are all hydrogen atoms are particularly preferred.

The compounds represented by formula (2) will be described in detail below.

Preferred examples of the substituents represented by $R^1$ each having a dissociative proton include phenyl groups having sulfonamido, sulfamoyl, acylsulfamoyl or carbamoyl (for example, 4-methanesulfonamidophenyl, 4-ethanesulfonamidophenyl, 4-propanesulfonamidophenyl, 4-butanesulfonamidophenyl, 4-benzenesulfonamidophenyl, 4-toluenesulfonamidophenyl, 4-(2,5-dimethylbenzenesulfonamido)phenyl, 4-(2-methoxyethanesulfonamido)phenyl, 4-(4-ethoxycarbonylmethylbenzenesulfonamido)phenyl, 4-(1-ethoxycarbonylpropanesulfonamido)phenyl, 4-(4-acetamidobenzenesulfonamido)phenyl, 4-anisylsulfonamidophenyl, 4-{3,5-bis(methoxycarbonyl)benzenesulfonamido}phenyl, 4-{2-(1-methoxy-2-propoxycarbonyl)benzenesulonamido}phenyl, 4-{3-(1-methoxy-2-propoxycarbonyl)benzenesulfonamido}phenyl, 4-{2-(3-methoxy-1-butoxycarbonyl)benzenesulfonamido}phenyl, 4-{3-(3-methoxy-1-butoxycarbonyl)benzenesulfonamido}phenyl, 4-butylsulfamoylphenyl, 4-valerylsulfamoylphenyl and 4-butylcarbamoylphenyl.

The groups represented by $R^{14}$ are preferably similar to those illustrated for $R^{11}$.

Of the compounds represented by formula (2), compounds in each of which Z is an oxygen atom.

Examples of the compounds used in the present invention are enumerated below, but the present invention is not limited thereto.

D-1

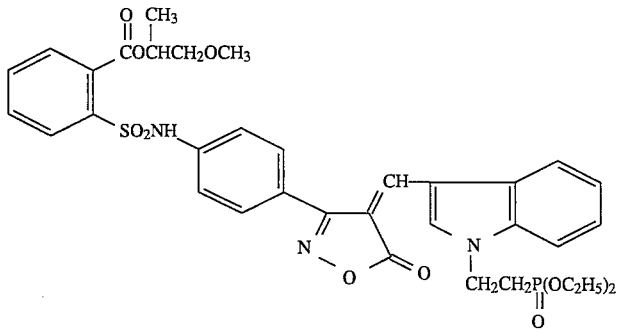

D-2

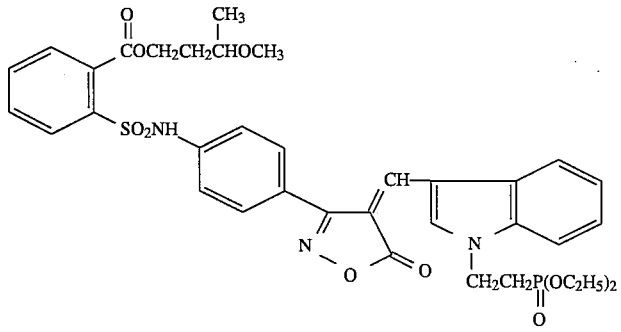

D-3

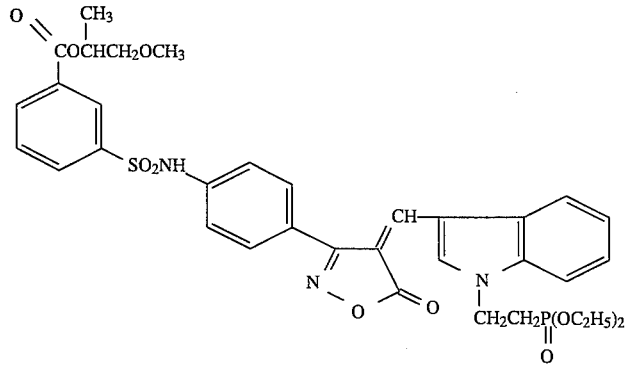

-continued
D-4
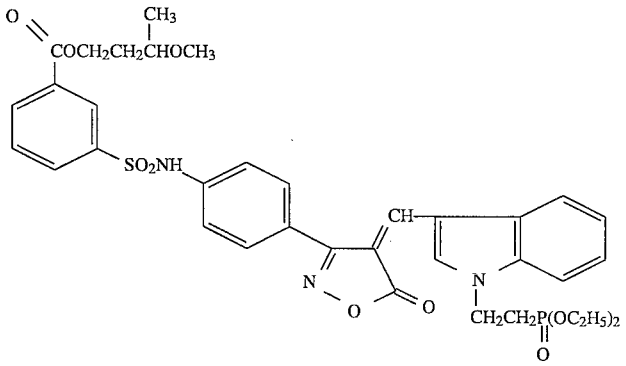
D-5
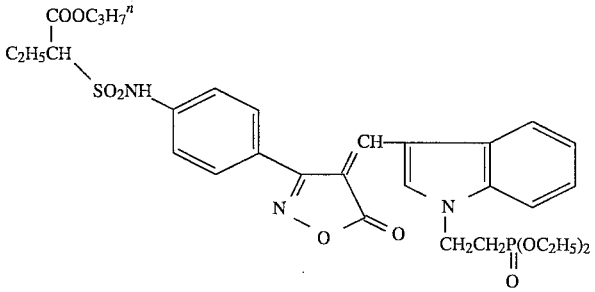
D-6
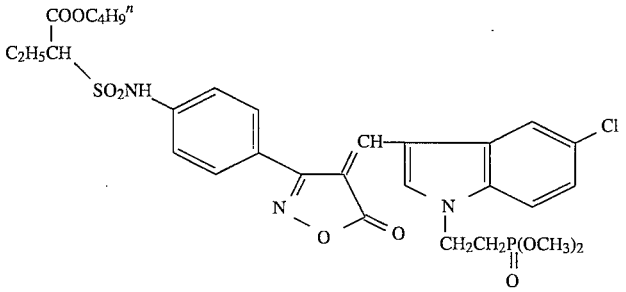
D-7
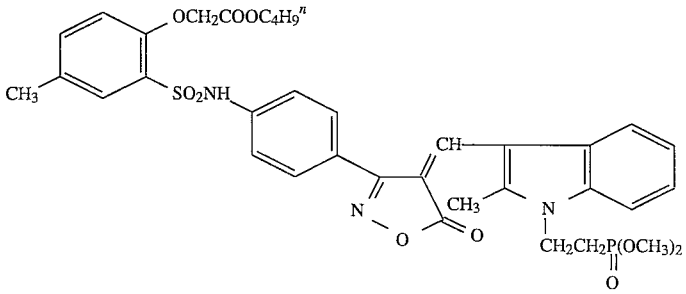
D-8
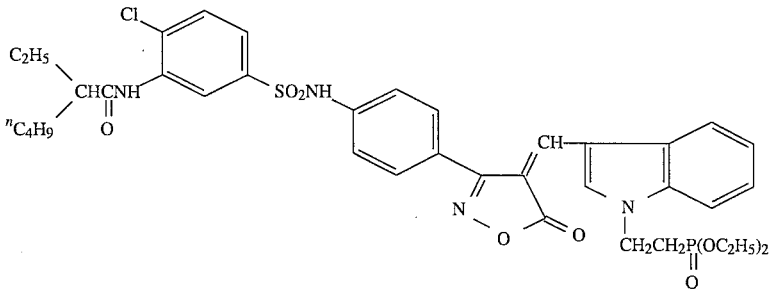

-continued
D-9
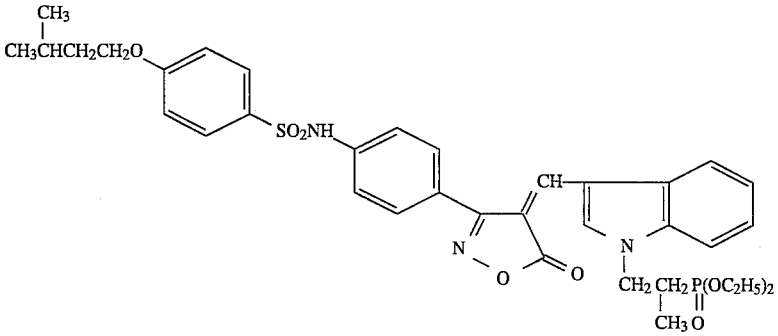
D-10
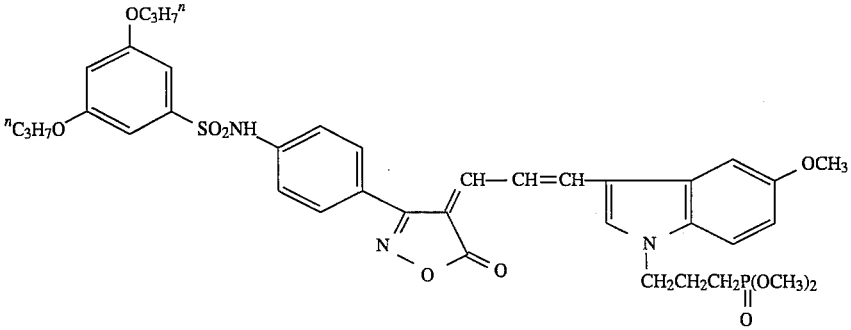
D-11
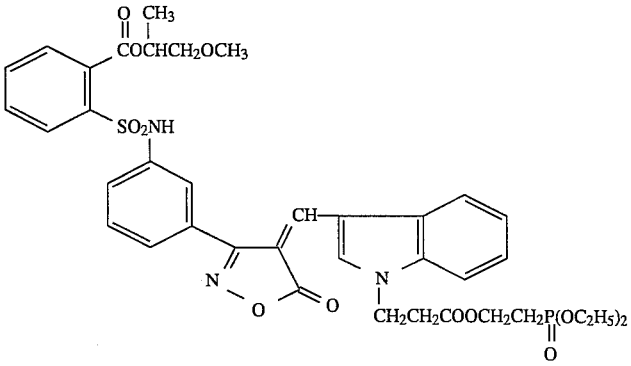
D-12
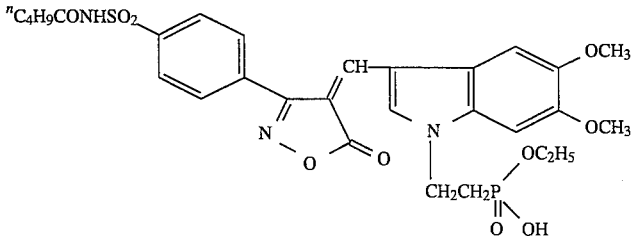
D-13
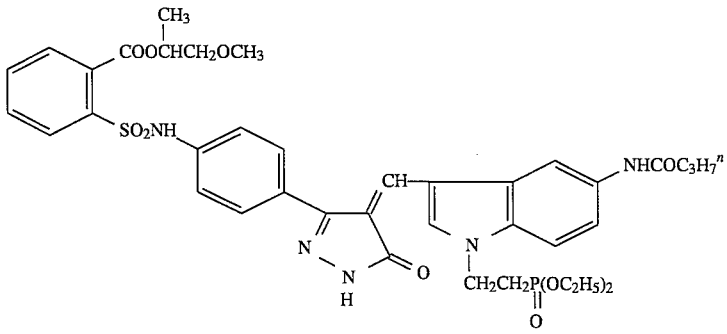

-continued
D-14
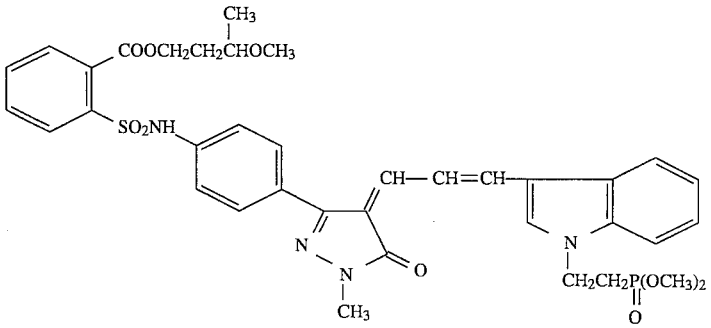
D-15
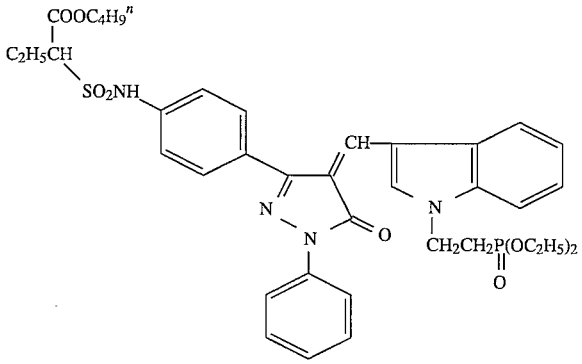
D-16
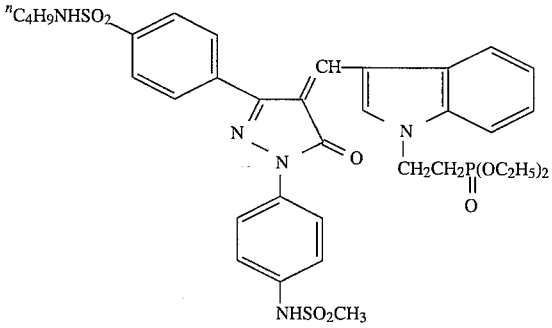
D-17
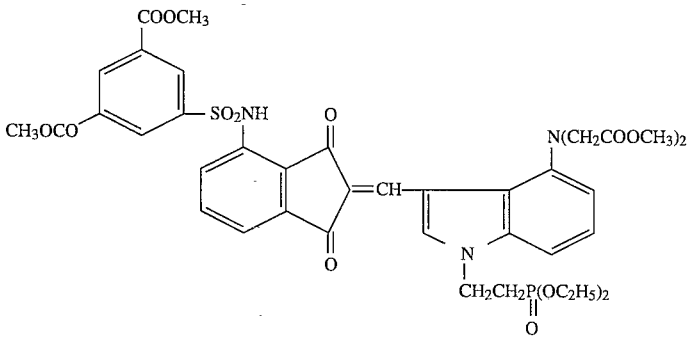

-continued
D-18
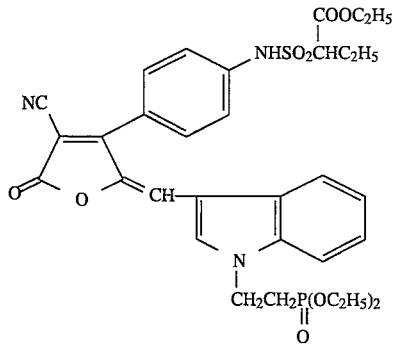
D-19
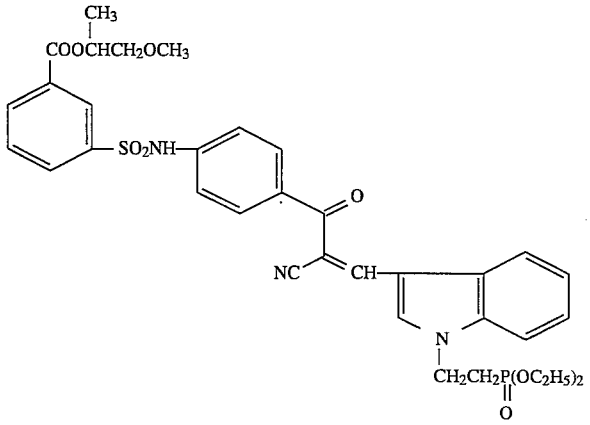
D-20
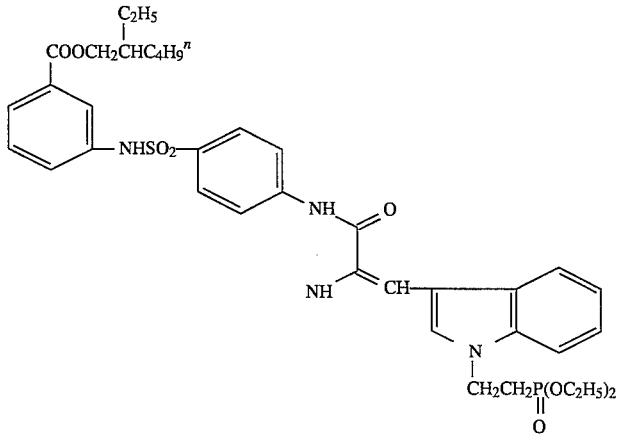
D-21
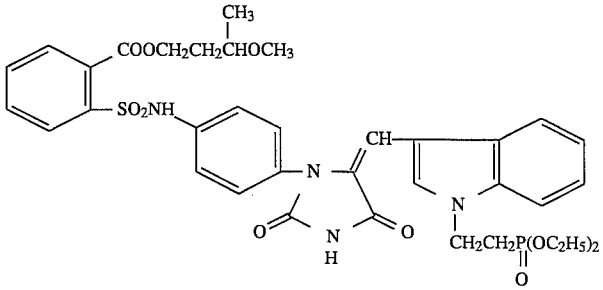

-continued
D-22
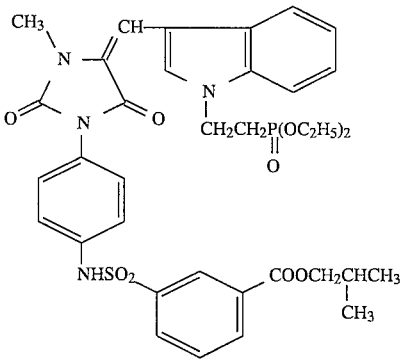
D-23
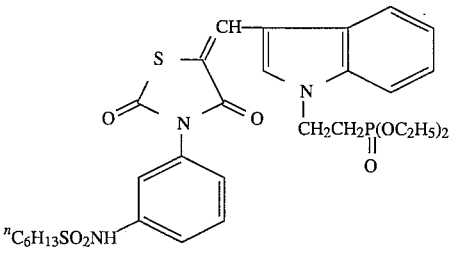
D-24
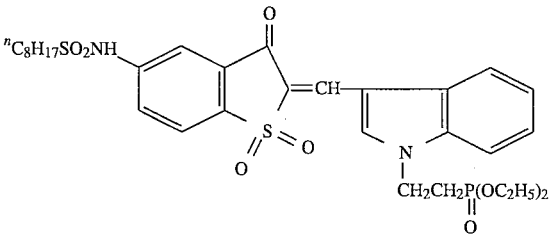
D-25
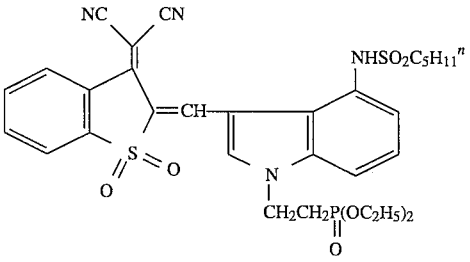
D-26
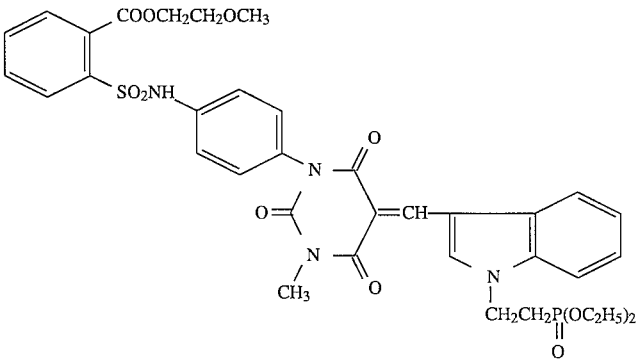

-continued

D-27

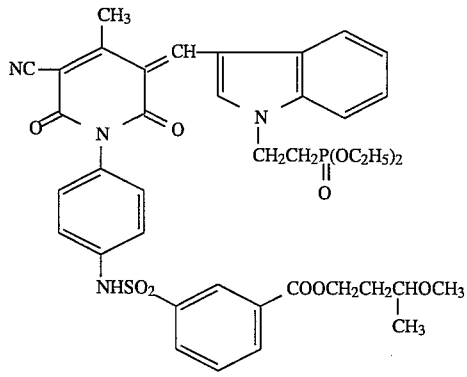

D-28

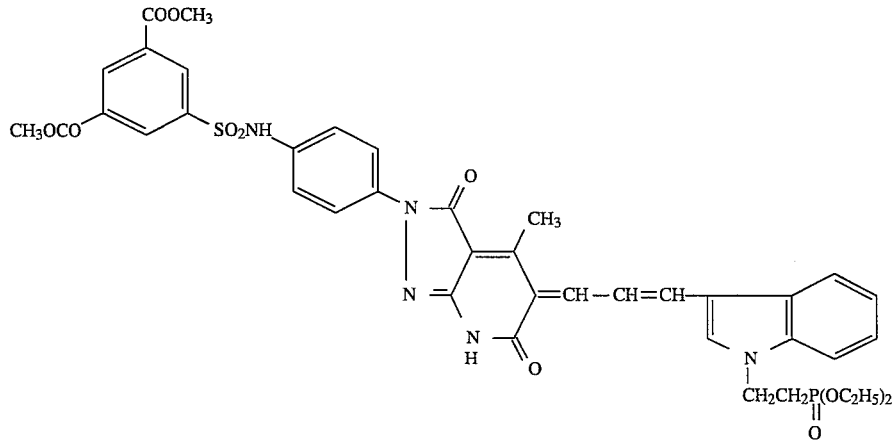

The compound represented by formula (1) in the present invention can be obtained by reacting a compound in which an active methylene moiety of acidic nucleus A (a moiety binding to $L^1$ in formula (1)) is unsubstituted, with a compound represented by formula (3) in an organic solvent (for example, methanol, ethanol, isopropyl alcohol, acetonitrile, N,N-dimethylformamide, N,N-dimethylacetamide, acetic acid or pyridine) at room temperature or under reflux conditions.

When the progress of reaction is slow, synthesis can be easily conducted by adding a proper amount of acetic acid, acetic anhydride, p-toluenesulfonic acid, triethylamine, piperidine, morpholine, pyridine, glycine, β-alanine or ammonium acetate.

(3)

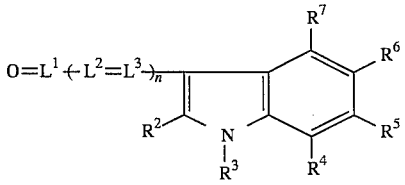

wherein $R^2$, $R^3$, $R^4$, $R^5$, $R^6$, $R^7$, $L^1$, $L^2$ and $L^3$ have the same meanings as defined in formula (1).

Synthesis examples are shown below.

(1) Synthesis of 2-(1-methoxy-2-propoxycarbonyl)benzenesulfonyl chloride

In 15 ml of N,N-dimethylformamide, 9.2 g of o-sulfobenzoic anhydride was dissolved, and 5.0 g of 1-methoxy-2-propanol was added dropwise thereto with stirring at room temperature. After heating at 70° C. for 1 hour and cooling to room temperature, 11.5 g of phosphorus oxychloride was further added dropwise, followed by stirring at room temperature for 6 hours. The reaction mixture was poured on 100 ml of ice water, and extracted with two 50 ml portions of ethyl acetate. After washing with an aqueous solution of sodium chloride, the extract was dried over magnesium sulfate, and concentrated to obtain 10.6 g of an oily product.

(2) Synthesis of ethyl 4-{2-(1-methoxy-2-propoxycarbonyl)benzenesulfonamido}benzoylacetate In 20 ml of N,N-dimethylacetamide, 8.3 g of ethyl (4-aminobenzoyl)acetate was dissolved, and 10.6 g of the above-described oily product was added thereto, followed by addition of 3.2 g of pyridine. After stirring at room temperature for 3 hours, 60 ml of 0.5N hydrochloric acid was added, followed by extraction with three 40 ml portions of ethyl acetate. After washing with an aqueous solution of sodium chloride, the extract was dried over magnesium sulfate, and concentrated to obtain 16.2 g of a solid material. This was further recrystallized from ethanol to obtain 12.8 g of crystals.

(3) Synthesis of 3-[4-{2-(1-methoxy-2-propoxycarbonyl)benzenesulfonamido}phenyl]-2-isoxazoline-5-one The mixture of 9.3 g of the above-described crystals, 1.6 g of hydroxylamine hydrochloride and 2.2 g of potassium acetate was dissolved in 30 ml of ethanol, and the solution was heated under reflux for 3 hours. After cooling to room temperature, 100 ml of water was gradually added thereto with stirring, resulting in precipitation of crystals. The crystals were separated by filtration, and washed with water and ethanol, followed by drying to obtain 6.9 g of crystals.

(4) Synthesis of diethyl 2-(3-formyl-1-indolyl)ethylphosphate

In 6 ml of acetonitrile, 2.9 g of indole-3-carbaldehyde, 5.0 g of diethyl vinylphosphonate and 3 drops of N,N,N',N'- tetramethylguanidine were dissolved, and the solution was heated under reflux for 5 hours. After the solution was allowed to cool, 20 ml of water was added thereto, followed by extraction with two 20 ml portions of ethyl acetate. After washing with an aqueous solution of sodium chloride, the extract was dried over magnesium sulfate, and concentrated to obtain 6.1 g of an oily product.

(5) Synthesis of compound D-1

In 80 ml of isopropyl alcohol, 4.3 g of the crystals obtained in (3) and 3.1 g of the oily product obtained in (4) were dissolved, and 3 drops of piperidine were added thereto, followed by heating under reflux for 2 hours. The resulting orange precipitate was separated by filtration, and recrystallized from a mixed solvent of methanol and isopropyl alcohol to obtain 6.0 g of a yellow powder, compound D-1 [λmax: 426 nm (ethyl acetate)].

The compounds represented by formula (1) are used in an amount of 1 to 1,000 mg, preferably 1 to 800 mg per $m^2$ of area of the photographic materials.

When the compounds represented by formula (1) are used as filter dyes or antihalation dyes, they can be used in any effective amount. However, it is preferred that they are used in such an amount as to give an optical density ranging from 0.5 to 3.5. They may be added at any stage prior to coating.

The compounds represented by formula (1) can be used in both emulsion layers and other hydrophilic colloidal layers.

The compounds represented by formula (1) used in the present invention can be dispersed in the oil compositions and/or the polymer compositions by the following methods:

(1) Methods in which the compounds are added to hydrophilic colloidal solutions as solutions of the compounds in oils, namely substantially water-insoluble high boiling solvents having a boiling point of about 160° C. or more, thereby dispersing the compounds therein Examples of the high boiling solvents which can be used include alkyl phthalates (such as dibutyl phthalate and dioctyl phthalate), phosphates (such as diphenyl phosphate, triphenyl phosphate, tricresyl phosphate and dioctyl butyl phosphate), citrates (such as tributyl acetylcitrate), benzoates (such as octyl benzoate), alkylamides (such as diethyllaurylamide), fatty acid esters (such as dibutoxyethyl succinate and diethyl azelate) and trimesates (such as tributyl trimesate) as described in U.S. Pat. No. 2,322,027. Further, organic solvent having a boiling point of about 30° to about 150° C., for example, lower alkyl acetates such as ethyl acetate and butyl acetate, ethyl propionate, secondary butyl alcohol, methyl isobutyl ketone, β-ethoxyethyl acetate and methyl cellosolve acetate, and solvents which are easily soluble in water, for example, alcohols such as methanol and ethanol, can also be used as an auxiliary solvent.

The compound/high boiling solvent ratio is preferably 10 to 1/10 (weight ratio).

The auxiliary solvent/high boiling solvent ratio is preferably 10 to 0 (weight ratio).

(2) Methods using polymers, namely polymers which are inactive to water and soluble in organic solvents, instead of the high boiling solvents or in combination with the high boiling solvents in (1) described above These methods are described, for example, in JP-A-5-5794, JP-A-5-45789 and Japanese Patent Application No. 3-44129 (corresponding to JP-A-5-158190).

Examples of the polymers which are inactive to water and soluble in organic solvents include (1) vinyl monopolymer or copolymer constituted from the group consisting of (a) acrylates (e.g., methyl acrylate, ethyl acrylate), (b) methacrylates (e.g., methyl acrylate, ethyl acrylate), (c) olefines (e.g., ethylene, propylene, butadiene, vinyl chloride), (d) stylenes (e.g., stylene), (e) acrylic acid, methacrylic acid and vinyl sulfonic acid, and (f) other vinyl monomers (e.g., vinyl ethers, vinyl esters, acrylamides) as a monomer component, and (2) polyesters (e.g., 1,4-butanedioladipic acid-polyester, polycaprolactone).

The compound/polymer ratio is preferably 10 to 1/10 (weight ratio).

(3) Methods in which photographic emulsion layers or other hydrophilic colloidal layers are allowed to contain the compounds of the present invention and other additives as filling polymer latex compositions The above-described polymer latices include, for example, urethane polymers and polymers obtained by polymerizing vinyl monomers. Suitable examples of the vinyl monomers include acrylates (such as methyl acrylate, ethyl acrylate, butyl acrylate, hexyl acrylate, octyl acrylate, dodecyl acrylate and glycidyl acrylate), α-substituted acrylates (such as methyl methacrylate, butyl methacrylate, octyl methacrylate and glycidyl methacrylate), acrylamides (such as butylacrylamide and hexylacrylamide), α-substituted acrylamides (such as butylmethacrylamide and dibutylmethacrylamide), vinyl esters (such as vinyl acetate and vinyl butyrate), vinyl halides (such as vinyl chloride), vinylidene halides (such as vinylidene chloride), vinyl ethers (such as vinyl methyl ether and vinyl octyl ether), styrene, X-substituted styrenes (such as α-methylstyrene), nucleus-substituted styrenes (such as hydroxystyrene, chlorostyrene and methylstyrene), ethylene, propylene, butylene, butadiene and acrylonitrile. These monomers may be used alone or as a combination of two or more of them. They may be mixed with other vinyl monomers as minor components. The other vinyl monomers which can be used include itaconic acid, acrylic acid, methacrylic acid, hydroxyalkyl acrylates, hydroxyalkyl methacrylates, sulfoalkyl acrylates, sulfoalkyl methacrylates and styrenesulfonic acid.

These filling polymer latices can be prepared in accordance with the methods described in JP-B-51-39853 (the term "JP-B" as used herein means an "examined Japanese patent publication"), JP-A-51-59943, JP-A-53-137131, JP-A-54-32552, JP-A-54-107941, JP-A-55-133465, JP-A-56-19043, JP-A-56-19047, JP-A-56-126830 and JP-A-58-149038.

The compound/polymer latex ratio is preferably 10 to 1/10 (weight ratio).

(4) Methods using hydrophilic polymers instead of the high boiling solvents or in combination with the high boiling solvents in (1) described above These methods are described, for example, in U.S. Pat. No. 3,619,195 and West German Patent 1,957,467.

Examples of the hydrophilic polymers include copolymers of hydrophilic vinyl monomers (e.g., acrylic acid, methacrylic acid, 3-acryloxypropane-1-sodium sulfonate, acrylamide, N-vinyl-2-pyrrolidone) and (meth)acrylates.

The compound/hydrophilic polymer ratio is preferably 10 to 1/10 (weight ratio).

(5) Methods in which the compounds are dissolved using surface active agents

Useful surface active agents are oligomers or polymers.

Details of the polymers are described in JP-A-60-158437, pages 19 to 27. Furthermore, the surface active agents described in JP-A-53-138726 are particularly preferred.

Examples of the surface active agents include nonionic surface active agents (e.g., poly(ethylene glycol, saponin); anionic surface active agents (e.g., alkylcarboxylates, alkylbenzenesulfonates, alkylsulfate esters); cationic surface active agents (e.g., aliphatic quaternary ammonium salts, heterocyclic quaternary ammonium salts); and amphoteric surface active agents (e.g., amino acids, alkylbetaines).

The compound/surface active agent ratio is preferably 10 to 1/10 (weight ratio).

Further, hydrosols of the hydrophilic polymers described, for example, in JP-B-51-39835 may be added to the hydrophilic colloidal dispersions obtained above.

Typical examples of the hydrophilic colloids include gelatin. However, any other colloids previously known as usable for photography can be used.

Silver halide emulsions used in the present invention are preferably silver bromide, silver iodobromide, silver iodochlorobromide, silver chlorobromide and silver chloride.

For silver halide emulsions, silver halide grains, protective colloids, additives (sensitizing agents, antifoggants, hardeners, etc.) to the silver halide emulsion layers and other layers of the photographic materials, etc., the contents described in JP-A-4-296848 (Japanese Patent Application No. 3-85744) page 10, column 18, line 21 to page 12, column 21, line 29 can be employed.

The photographic materials prepared according to the present invention may contain water-soluble dyes in the hydrophilic colloidal layers, as filter dyes, for the purpose of preventing irradiation or halation, or for other various purposes. Preferred examples of such dyes include oxonol dyes, hemioxonol dyes, styryl dyes, merocyanine dyes, anthraquinone dyes and azo dyes. In addition to them, cyanine dyes, azomethine dyes, triarylmethane dyes and phthalocyanine dyes are also useful. Oil-soluble dyes emulsified by oil-in-water dispersing methods can also be added to the hydrophilic colloidal layers.

For supports, multi-layer multi-color photographic materials, coating methods, color, and black and white materials, diffusion transfer materials, exposure means, processings such as development, etc. applied to the photographic materials of the present invention, the descriptions given in JP-A-4-296848 (Japanese Patent Application No. 3-85744), page 12, column 21, line 41 to page 16, column 29, line 23 can be employed.

The present invention will be further illustrated in greater detail with reference to the following examples.

EXAMPLE 1

Emulsion NY-2 containing compound D-1 of the present invention was prepared as follows. The following components for an oil phase and an aqueous phase were each dissolved by heating, and mixed with each other. The mixture was dispersed by use of a mixer for domestic use to prepare emulsion NY-2.

| | |
|---|---|
| (Oil Phase) | |
| Compound D-1 of the Present Invention | 30.2 g |
| Compound ExO-1 | 12.5 g |
| Surface Active Agent W-4 | 4.6 g |
| Tricresyl Phosphate | 37.3 g |
| Ethyl Acetate | 108 g |
| (Aqueous Phase) | |
| Bovine Bone Gelatin ($Ca^{2+}$ content: 1,000 ppm, average molecular weight: 500,000) | 94.4 g |
| Water to make | 1,200 g |

Emulsions NY-1, NY-3 and NY-4 as shown in Table 1 were prepared in the same manner as with emulsion NY-2.

Emulsion NY-1 thus prepared was applied immediately after preparation in the following manner to prepare sample 101.

A yellow filter layer and a protective layer were formed on a triacetyl cellulose film support having an underlayer so as to give the following amounts coated:

| | |
|---|---|
| First Layer: Yellow Filter Layer | |
| Compound D-1 of the Present Invention | 0.30 g/m$^2$ |
| Compound ExO-1 | 0.12 g/m$^2$ |
| Tricresyl Phosphate | 0.37 g/m$^2$ |
| Gelatin | 0.94 g/m$^2$ |
| Second Layer: Protective Layer | |
| Gelatin | 1.20 g/m$^2$ |
| Polymethyl Methacrylate Grains (diameter: 2.0 μm) | 0.04 g/m$^2$ |
| Na Salt of 2,4-Dichloro-6-Hydroxy-s-Triazine | 0.09 g/m$^2$ |

Samples 102 to 104 were prepared as shown in Table 1 in accordance with the method by which sample 101 was prepared.

The stability with the lapse of time under cold storage of the emulsions was evaluated in the following manner. Emulsions NY-1 to 4 were stored in a refrigerator controlled to a temperature of 8° C. for 30 days, and thereafter, samples 101R to 104R using the emulsions after cold storage were prepared in the same manner as with samples 101 to 104.

The density was measured with a blue filter for samples 101 to 104 and samples 101R to 104R.

The optical density of samples 101 to 104 prepared using the emulsions immediately after emulsification was compared with that of samples 101R to 104R prepared using the emulsions after cold storage to determine drops in density due to cold storage of the emulsions as relative values, which were taken as representative values.

The results of Table 1 reveal that the compounds represented by formula (1) in the present invention are excellent in solubility, and that the emulsions using these compounds are favorably improved in stability with the lapse of time under cold storage.

TABLE 1

| Sample | Emulsion | Dye | Stability with the Lapse of Time under Cold Storage of Emulsion | Surface State of Sample after Cold Storage |
|---|---|---|---|---|
| 101, 101R (Comparison) | NY-1 | SEN-1 | 68 | "Granular projections" were observed |
| 102, 102R (Invention) | NY-2 | D-1 | 99 | Good |
| 103, 103R (Invention) | NY-3 | D-3 | 97 | Good |
| 104, 104R (Invention) | NY-4 | D-6 | 98 | Good |

EXAMPLE 2

A cellulose triacetate film support having an underlayer was coated with the following respective compositions in multiple layers to prepare sample 201, a multiple layer color photographic material.

(Compositions of Respective Layers)

Materials used in the respective layers are classified as follows:

ExC: Cyan Coupler
ExM: Magenta Coupler
ExY: Yellow Coupler
ExS: Sensitizing Dye
ExU: Ultraviolet Light Absorber
S: Formalin Scavenger or Fogging Inhibitor
F: Additive (Stabilizer, Fogging Inhibitor, etc.)
HBS: High Boiling Organic Solvent
ExO: Color Mixing Inhibitor
W: Surface Active Agent
H: Hardening Agent for Gelatin
B: Polymer Numerals corresponding to respective components indicate amounts coated in g/m$^2$. For silver halides, numerals indicate amounts coated which are converted to silver. However, for sensitizing dyes, numerals indicate amounts coated in mole per mole of silver halides in the same layers.

(Sample 201)

| | | |
|---|---|---|
| First Layer (Antihalation Layer) | | |
| Black Colloidal Silver | silver | 0.118 |
| Gelatin | | 1.8 |
| Second Layer (Intermediate Layer) | | |
| 2,5-Di-t-Pentadecylhydroquinone | | 0.23 |
| ExM-1 | | 0.065 |
| ExC-1 | | 0.020 |
| ExS-1 | | 0.0020 |
| ExU-1 | | 0.060 |
| ExU-2 | | 0.080 |
| ExU-3 | | 0.10 |
| HBS-1 | | 0.10 |
| HBS-2 | | 0.018 |
| Gelatin | | 1.2 |
| Third Layer (Low Sensitivity Red-Sensitive Emulsion Layer) | | |
| Emulsion A | silver | 0.27 |
| Emulsion B | silver | 0.32 |
| ExS-3 | | $1.7 \times 10^{-4}$ |
| ExS-4 | | $1.8 \times 10^{-5}$ |
| ExS-5 | | $2.5 \times 10^{-4}$ |
| ExC-2 | | 0.020 |
| ExC-3 | | 0.17 |
| ExC-4 | | 0.17 |
| ExC-5 | | 0.020 |
| ExM-3 | | 0.020 |
| ExU-1 | | 0.070 |
| ExU-2 | | 0.050 |
| ExU-3 | | 0.070 |
| HBS-1 | | 0.060 |
| F-18 | | 0.028 |
| Gelatin | | 0.92 |
| Fourth Layer (Medium Sensitivity Red-Sensitive Emulsion Layer) | | |
| Emulsion D | silver | 0.90 |
| ExS-3 | | $1.0 \times 10^{-4}$ |
| ExS-4 | | $1.4 \times 10^{-5}$ |
| ExS-5 | | $2.0 \times 10^{-4}$ |
| ExC-1 | | 0.010 |
| ExC-2 | | 0.010 |
| ExC-3 | | 0.050 |
| ExC-4 | | 0.050 |
| ExC-6 | | 0.080 |
| F-18 | | 0.018 |
| Gelatin | | 0.66 |
| Fifth Layer (High Sensitivity Red-Sensitive Emulsion Layer) | | |

-continued (Sample 201)

| | | |
|---|---|---|
| Emulsion G | silver | 1.3 |
| ExS-3 | | $1.2 \times 10^{-4}$ |
| ExS-4 | | $1.2 \times 10^{-4}$ |
| ExS-5 | | $2.2 \times 10^{-4}$ |
| ExC-1 | | 0.050 |
| ExC-2 | | 0.015 |
| ExC-3 | | 0.18 |
| ExC-4 | | 0.22 |
| ExC-7 | | 0.22 |
| ExC-8 | | 0.020 |
| ExU-1 | | 0.070 |
| ExU-2 | | 0.050 |
| ExU-3 | | 0.070 |
| HBS-1 | | 0.22 |
| HBS-2 | | 0.12 |
| F-18 | | 0.030 |
| Gelatin | | 1.6 |
| Sixth Layer (Intermediate Layer) | | |
| ExO-1 | | 0.040 |
| ExM-4 | | 0.050 |
| HBS-1 | | 0.020 |
| Gelatin | | 0.75 |
| Seventh Layer (Low Sensitivity Green-Sensitive Emulsion Layer) | | |
| Emulsion A | silver | 0.18 |
| Emulsion B | silver | 0.13 |
| Emulsion C | silver | 0.12 |
| ExS-2 | | $5.0 \times 10^{-5}$ |
| ExS-6 | | $3.0 \times 10^{-5}$ |
| ExS-7 | | $1.0 \times 10^{-4}$ |
| ExS-8 | | $3.8 \times 10^{-4}$ |
| ExM-1 | | 0.021 |
| EXM-3 | | 0.030 |
| ExM-5 | | 0.20 |
| ExM-6 | | 0.0050 |
| ExM-7 | | 0.10 |
| HBS-1 | | 0.10 |
| HBS-3 | | 0.010 |
| Gelatin | | 0.60 |
| Eighth Layer (Intermediate Layer) | | |
| ExM-4 | | 0.016 |
| ExC-8 | | 0.042 |
| HBS-1 | | 0.16 |
| HBS-3 | | 0.0080 |
| Gelatin | | 0.45 |
| Ninth Layer (High Sensitivity Green-Sensitive Emulsion Layer) | | |
| Emulsion E | silver | 1.0 |
| ExS-2 | | $0.60 \times 10^{-5}$ |
| ExS-6 | | $3.4 \times 10^{-5}$ |
| ExS-7 | | $8.4 \times 10^{-5}$ |
| ExS-8 | | $3.1 \times 10^{-4}$ |
| ExM-3 | | 0.025 |
| ExM-8 | | 0.015 |
| ExM-9 | | 0.50 |
| ExY-1 | | 0.020 |
| HBS-1 | | 0.25 |
| HBS-2 | | 0.10 |
| Gelatin | | 1.6 |
| Tenth Layer (Intermediate Layer) | | |
| ExO-1 | | 0.040 |
| HBS-1 | | 0.020 |
| Gelatin | | 0.71 |
| Eleventh Layer (Donor Layer of Multiple Layer Effect to Red-Sensitive Layer) | | |
| Emulsion J | silver | 1.5 |
| Emulsion K | silver | 1.7 |
| ExS-2 | | $4.0 \times 10^{-4}$ |
| ExC-2 | | 0.10 |
| ExM-2 | | 0.10 |

-continued (Sample 201)

| | | |
|---|---|---|
| HBS-1 | | 0.10 |
| HBS-2 | | 0.10 |
| Gelatin | | 0.80 |
| Twelfth Layer (Yellow Filter Layer) | | |
| Yellow Colloidal Silver | silver | 0.085 |
| ExO-1 | | 0.077 |
| HBS-1 | | 0.030 |
| Gelatin | | 0.98 |
| Thirteenth Layer (Low Sensitivity Blue-Sensitive Emulsion Layer) | | |
| Emulsion A | silver | 0.075 |
| Emulsion B | silver | 0.073 |
| Emulsion F | silver | 0.068 |
| ExS-9 | | $3.5 \times 10^{-4}$ |
| ExC-3 | | 0.042 |
| ExY-2 | | 0.72 |
| ExY-3 | | 0.020 |
| HBS-1 | | 0.27 |
| Gelatin | | 1.0 |
| Fourteenth Layer (Medium Sensitivity Blue-Sensitive Emulsion Layer) | | |
| Emulsion G | silver | 0.46 |

-continued (Sample 201)

| | | |
|---|---|---|
| ExS-9 | | $2.1 \times 10^{-4}$ |
| ExY-1 | | 0.010 |
| ExY-2 | | 0.60 |
| ExY-3 | | 0.010 |
| HBS-1 | | 0.070 |
| Gelatin | | 0.63 |
| Sixteenth Layer (Protective Layer) | | |
| Emulsion I | silver | 0.22 |
| ExU-4 | | 0.11 |
| ExU-5 | | 0.17 |
| HBS-1 | | 0.050 |
| W-1 | | 0.020 |
| H-1 | | 0.40 |
| B-1 (diameter: about 1.5 μm) | | 0.10 |
| B-2 (diameter: about 1.5 μm) | | 0.10 |
| B-3 | | 0.020 |
| S-1 | | 0.20 |
| Gelatin | | 1.8 |

In addition to the above, 1,2-benzisothiazoline-3-one (200 ppm to gelatin on average), n-butyl-p-hydroxy-benzoate (similarly, about 1,000 ppm) and 2-phenoxyethanol (similarly, about 10,000 ppm) were added to the sample thus prepared. The sample further contains W-2, W-3, B-4 to B-6, F-1 to F-17, an iron salt, a lead salt, a gold salt a platinum salt, an iridium salt and a rhodium salt.

TABLE 2

| | Mean Content of AgI (%) | Mean Grain Size (μm) | Coefficient of Variation Relating to Grain Size (%) | Diameter/ Thickness Ratio | Ratio of Silver Amount (AgI Content) (%) |
|---|---|---|---|---|---|
| Emulsion A | 4.0 | 0.45 | 27 | 1 | Core/shell = 1/3(13/1), double structure grain |
| Emulsion B | 8.9 | 0.70 | 14 | 1 | Core/shell = 3/7(25/2), double structure grain |
| Emulsion C | 10 | 0.75 | 30 | 2 | Core/shell = 1/2(24/3), double structure grain |
| Emulsion D | 16 | 1.05 | 35 | 2 | Core/shell = 4/6(40/0), double structure grain |
| Emulsion E | 10 | 1.05 | 35 | 3 | Core/shell = 1/2(24/3), double structure grain |
| Emulsion F | 4.0 | 0.25 | 28 | 1 | Core/shell = 1/3(13/1), double structure grain |
| Emulsion G | 14.0 | 0.75 | 25 | 2 | Core/shell = 1/2(42/0), double structure grain |
| Emulsion H | 14.5 | 1.30 | 25 | 3 | Core/shell = 37/63(34/3), double structure grain |
| Emulsion I | 1 | 0.07 | 15 | 1 | Homogeneous grain |
| Emulsion J | 5 | 0.90 | 30 | 2 | Core/shell = 1/1(10/0), double structure grain |
| Emulsion K | 7 | 1.50 | 25 | 2 | Core/shell = 1/1(14/0), double structure grain |

-continued (Sample 201)

| | | |
|---|---|---|
| ExS-9 | | $2.1 \times 10^{-4}$ |
| ExY-2 | | 0.15 |
| ExC-2 | | 0.0070 |
| HBS-1 | | 0.050 |
| Gelatin | | 0.81 |
| Fifteenth Layer (High Sensitivity Blue-Sensitive Emulsion Layer) | | |
| Emulsion H | silver | 0.80 |

In Table 2, (1) Emulsions A to K are subjected to reduction sensitization using thiourea dioxide and thiosulfonic acid in preparing the grains according to the examples of JP-A-2-191938;

(2) Emulsions A to K are subjected to gold sensitization, sulfur sensitization and selenium sensitization in the presence of the spectral sensitizing dyes contained in the respective sensitive layers and sodium thiocyanate according to the examples of Japanese Patent Application No. 2-34090 (corresponding to JP-A-3-237450);

(3) For preparation of tabular grains, gelatin having a low molecular weight is used according to JP-A-1-158426; and (4) Dislocation lines as described in Japanese Patent Application No. 2-34090 (corresponding to JP-A-3-237450) are observed in tabular grains and normal crystalline grains having grain structure under a high-voltage electron microscope.

(Preparation of Samples 202 to 208)

To 1 kg of comparative compound SEN-1, 1.2 kg of high boiling organic solvent HBS-1, 280 g of ExO-1, 150 g of surface active agent W-4 and 4 liters of ethyl acetate were added, forming a solution by heating. The solution was mixed with 30 kg of a 10% aqueous solution of gelatin, and dispersed by use of a high-speed stirring emulsifier (1,500 rpm) for 30 minutes to prepare emulsified product A.

Using emulsified product A, sample 202 was prepared in the same manner as with sample 201, with the exception that yellow colloidal silver contained in the yellow filter layer of sample 201 was replaced by $4.86\times10^{-4}$ mole/m$^2$ of comparative compound SEN-1.

Samples 203 to 207 were prepared in the same manner as with sample 201, with the exception that SEN-1 of sample 202 was replaced by equimolar comparative compound SEN-2, and compounds D-1, D-3, D-6 and D-15 of the present invention, respectively.

Further, sample 208 was prepared in the same manner as with the above-described samples, with the exception that the compounds of samples 202 to 207 were removed.

After imagewise exposure, samples 201 to 207 described above were subjected to color development shown below, and the resulting image density was measured. The relative sensitivity of green-sensitive layers determined from the magenta color image density is shown in Table 3. The sensitivity is indicated by the logarithm of the reciprocal of an exposure necessary to increase the optical density by 0.2 from the minimum density of the magenta color image density, and the relative sensitivity is indicated by the difference from the sensitivity of sample 201.

The decolorizing property of the compounds in development was evaluated in the following manner. That is to say, sample 208 from which the compounds were removed was exposed and developed by the same methods as described above to measure the yellow minimum density. The difference in yellow minimum density between each of samples 202 to 207 and sample 208 was determined. These values are shown in Table 3 as representative values indicating the decolorizing property. It is preferred that these values are smaller, because smaller amounts of dyes are left after development.

Further, fluctuations in yellow minimum density obtained when the amount of sodium sulfite added to a color developing solution and that of ammonium sulfite added to a fixing solution in the above-described processing methods were each reduced to 35% are shown in Table 3.

Furthermore, for samples 201 to 207, changes in sensitivity according to the yellow color image density after the elapse of 14 days under the conditions of high temperature and humidity, at 40° C. at 80%, are shown in Table 3 as the relative sensitivity to that before the elapse of time.

TABLE 3

| Sample | Compound of Yellow Filter Layer | Sensitivity of Green-Sensitive Layer (Relative Sensitivity) | Decolorizing Property of Dye | Fluctuations in Yellow Minimum Density Due to Fluctuations in Processing | Changes in Blue-Sensitive Sensitivity after Storage at 40° C. at 80% for 14 Days |
|---|---|---|---|---|---|
| 201 (Comparison) | Colloidal silver | 0 | — | 0.04 | −0.05 |
| 202 (Comparison) | SEN-1 | +0.15 | 0.08 | 0.07 | −0.08 |
| 203 (Comparison) | SEN-2 | +0.14 | 0.04 | 0.04 | −0.15 |
| 204 (Invention) | D-1 | +0.15 | 0.03 | 0.02 | −0.03 |
| 205 (Invention) | D-3 | +0.15 | 0.02 | 0.02 | −0.02 |
| 206 (Invention) | D-6 | +0.15 | 0.03 | 0.02 | −0.02 |
| 207 (Invention) | D-15 | +0.15 | 0.03 | 0.02 | −0.03 |

The results shown in Table 3 prove that the photographic materials of the present invention are highly sensitive, sufficient in decolorizing property of the compounds, small in dependency on fluctuations in processing, and excellent in keeping quality.

(Processing Method)

| Stage | Processing Time | Processing Temperature |
|---|---|---|
| Color Development | 3 minutes and 15 seconds | 38° C. |
| Bleaching | 3 minutes | 38° C. |
| Washing | 30 seconds | 24° C. |
| Fixing | 3 minutes | 38° C. |
| Washing (1) | 30 seconds | 24° C. |
| Washing (2) | 30 seconds | 24° C. |
| Stabilization | 30 seconds | 38° C. |
| Drying | 4 minutes and 20 seconds | 55° C. |

Compositions of processing solutions are described below:

| | (unit: g) |
|---|---|
| (Color Developing Solution) | |
| Diethylenetriaminepentaacetic Acid | 1.5 |
| 1-Hydroxyethylidene-1,1-diphosphonic Acid | 1.2 |
| Sodium Sulfite | 4.0 |
| Potassium Carbonate | 30.0 |
| Potassium Bromide | 1.4 |
| Potassium Iodide | 1.5 mg |
| Hydroxylamine Sulfate | 2.4 |
| 4-[N-Ethyl-N-(β-hydroxyethyl)amino]-2-methylaniline Sulfate | 4.5 |
| Water to make | 1.0 liter |
| pH (adjusted with potassium hydroxide and sulfuric acid) | 10.05 |
| (Bleaching Solution) | |
| Ethylenediaminetetraacetic Acid Fe(III) Sodium Trihydrate | 100.0 |
| Disodium Ethylenediaminetetraacetate | 10.0 |
| 3-Mercapto-1,2,4-triazole | 0.03 |
| Ammonium Bromide | 140.0 |
| Ammonium Nitrate | 30.0 |
| Aqueous Ammonia (27%) | 6.5 ml |
| Water to make | 1.0 liter |
| pH (adjusted with aqueous ammonia and nitric acid) | 6.0 |
| (Fixing Solution) | |
| Disodium Ethylenediaminetetraacetate | 0.5 |
| Ammonium Sulfite | 20.0 |
| Aqueous Ammonium Thiosulfate (700 g/liter) | 295.0 ml |
| Acetic Acid (90%) | 3.3 |
| Water to make | 1.0 liter |
| pH (adjusted with aqueous ammonia and acetic acid) | 6.7 |
| (Stabilizing Solution) | |
| p-Nonylphenoxy Polyglycidol (average degree of polymerization of glycidol: 10) | 0.2 |
| Ethylenediaminetetraacetic Acid | 0.05 |

-continued

| | (unit: g) |
|---|---|
| Hydroxyacetic Acid | 0.02 |
| Hydroxyethyl Cellulose (HEC SP-2000, DAICEL Chemical Industries, Ltd.) | 0.1 |
| 1,2-Benzisothiazoline-3-one | 0.05 |
| Water to make | 1.0 liter |
| pH | 8.5 |

EXAMPLE 3

For samples in which the emulsions of Example 2 were replaced by emulsions L to P as shown below, similar effects were also obtained.

TABLE 4

| Emulsion of Example 2 | Replaced Emulsion | Ag Amount Coated |
|---|---|---|
| Emulsion A | Emulsion M | 100% (based on Example 2) |
| Emulsion B | Emulsion O | 70% |
| Emulsion C | Emulsion L | 50% |
| Emulsion D | Emulsion N | 50% |
| Emulsion E | Emulsion N | 70% |
| Emulsion F | Not replaced | |
| Emulsion G | Emulsion L | 40% |
| Emulsion H | Emulsion P | 30% |
| Emulsion I | Not replaced | |
| Emulsion J | Emulsion L | 100% |
| Emulsion K | Emulsion P | 70% |

TABLE 5

| Emulsion No. | Mean Content of AgI | Mean Content of AgCl | Mean Grain Size (μm) | Coefficient of Variation Relating to Grain Size | Diameter/ Thickness Ratio | Ratio of Silver Amount (Core/Inter-mediate/Shell) (AgI Content) | Grain Structure |
|---|---|---|---|---|---|---|---|
| L | 6 mole % | — | 0.80 | 18% | 7.5 | [1/4/1] (0/4/12) | Triple structure grains having AgI outside |
| M | 4 mole % | — | 0.45 | 15% | 6.0 | [1/1] (0/8) | Double structure grains having AgI outside |
| N | 6 mole % | — | 0.95 | 15% | 7.8 | [1/3/1] (0/10/0) | Triple structure grains having AgI inside |
| O | 6 mole % | — | 0.50 | 18% | 5.5 | [1/3/1] (0/10/0) | Triple structure grains having AgI inside |
| P | 6 mole % | 8 mole % | 1.20 | 20% | 7.8 | [1/3/1] (0/10/0) | Triple structure grains having AgI inside |

(Cl is contained in shells)

-continued

| | (unit: g) |
|---|---|
| 1,2,4-Triazole | 1.3 |
| 1,4-Bis(1,2,4-triazole-1-ylmethyl)piperazine | 0.75 |

Compounds used in the examples are shown below.

ExM-1
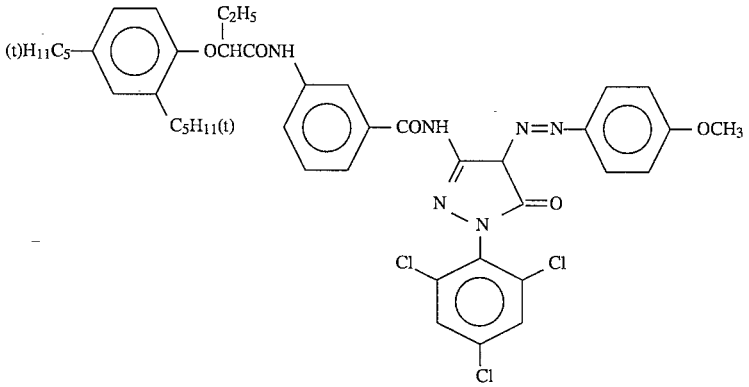
ExM-2
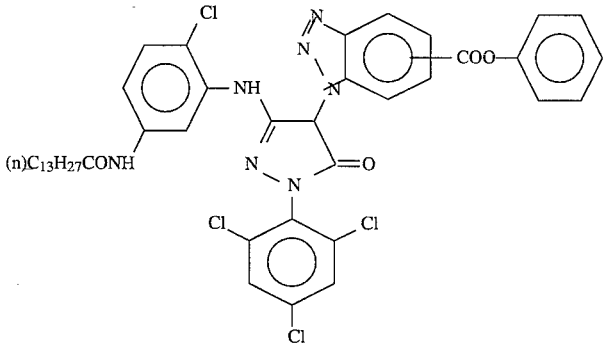
ExM-3
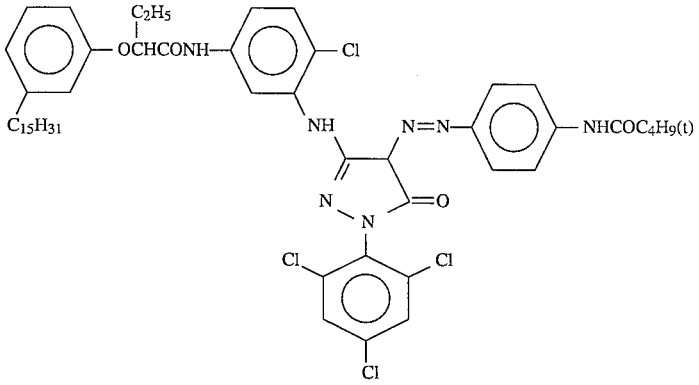
ExM-4
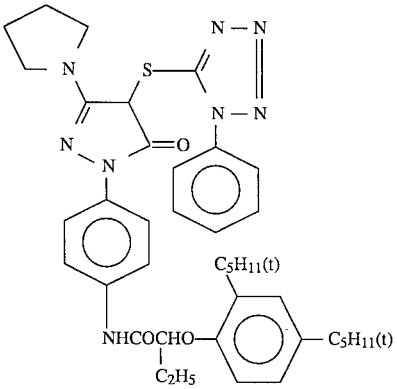

-continued
ExM-5
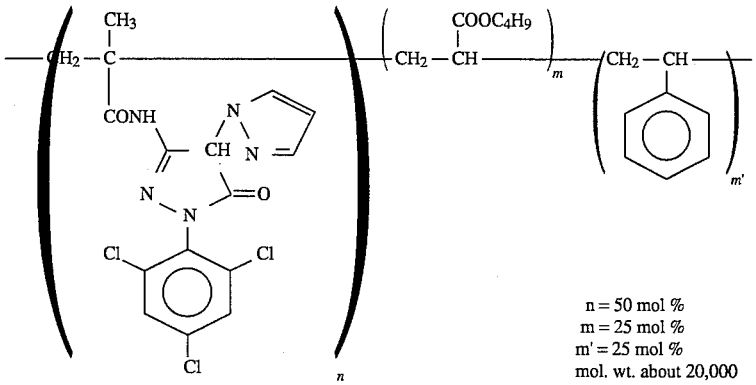
ExM-6
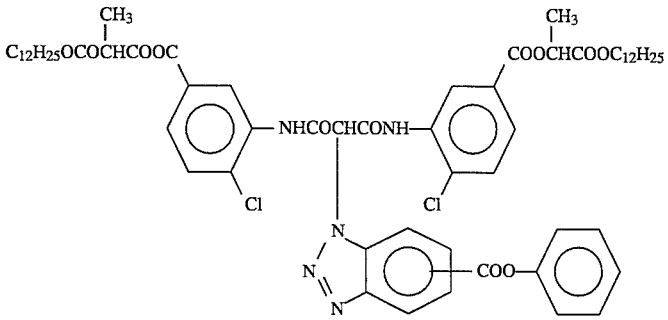
ExM-7
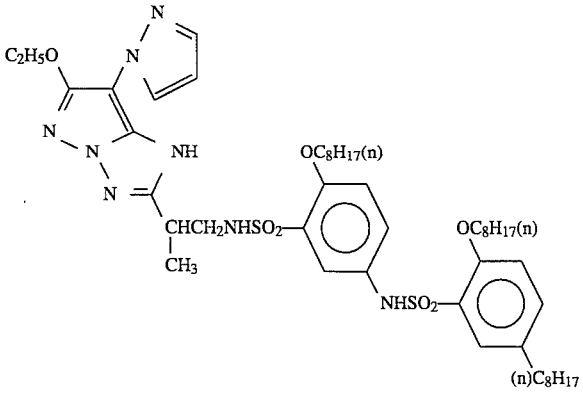
ExM-8
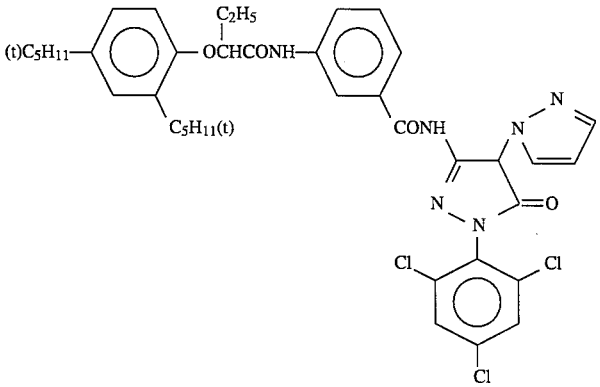

-continued
ExM-9
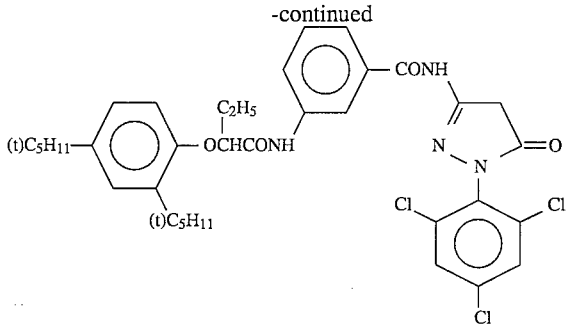
ExC-1
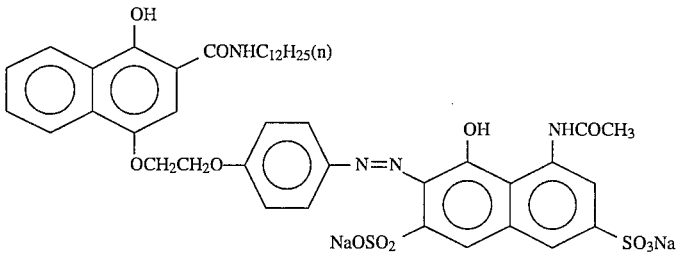
ExC-2
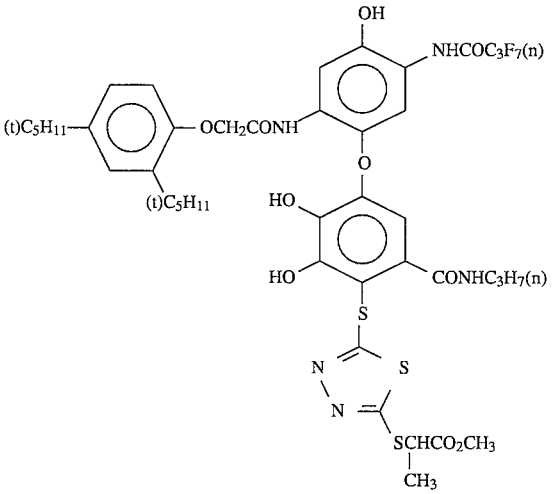
ExC-3
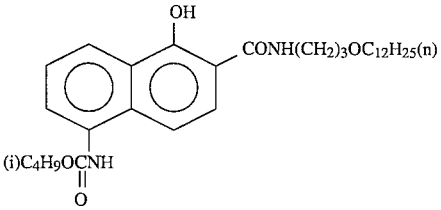
ExC-4
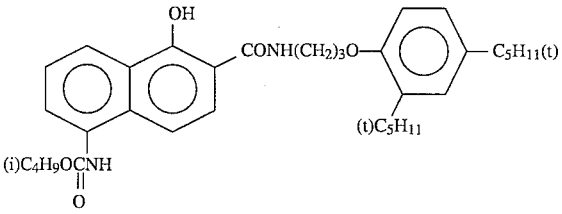

-continued
ExC-5
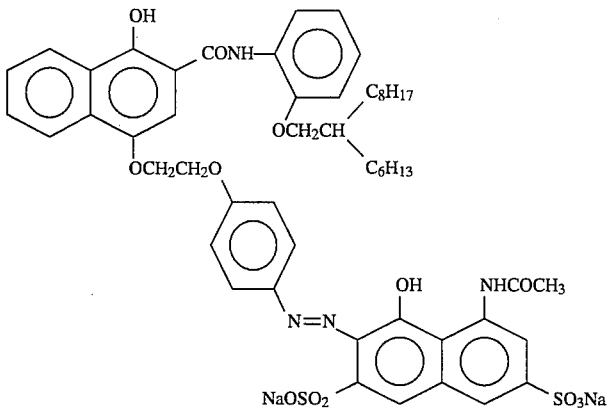
ExC-6
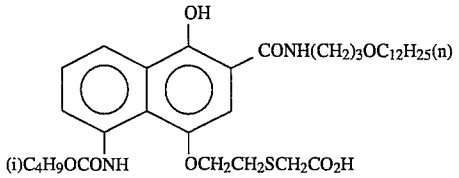
ExC-7
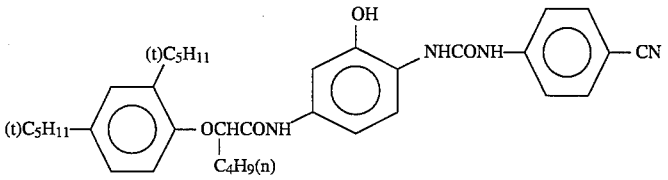
ExC-8
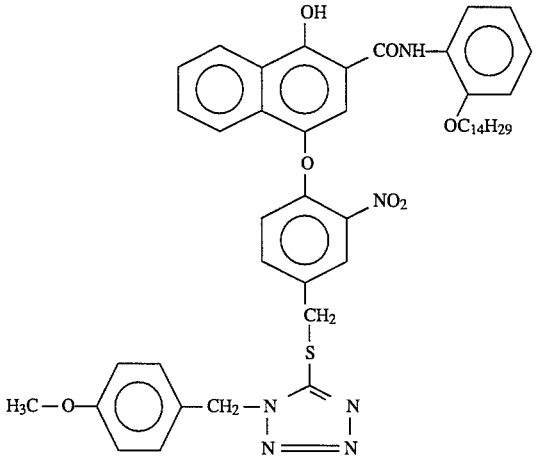
ExY-1
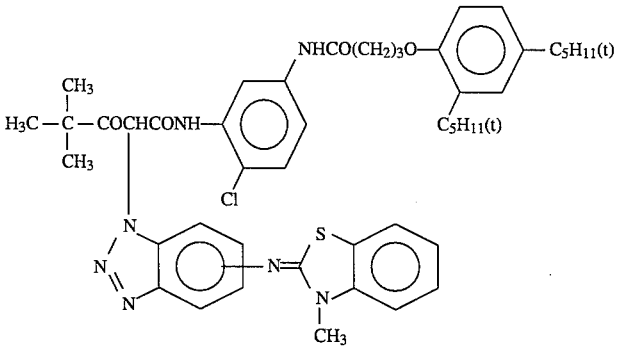

-continued
ExY-2
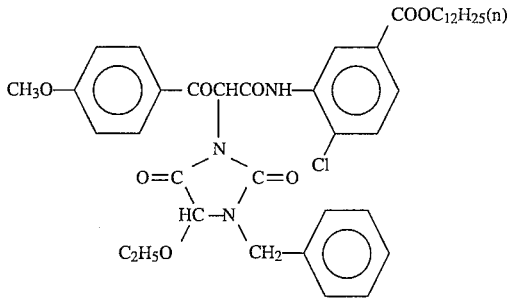
ExY-3
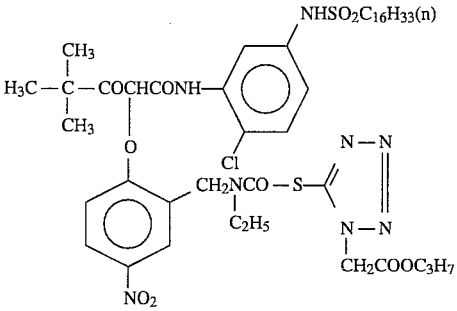
ExU-1
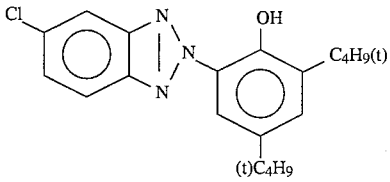
ExU-2
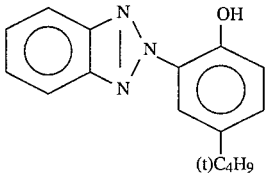
ExU-3
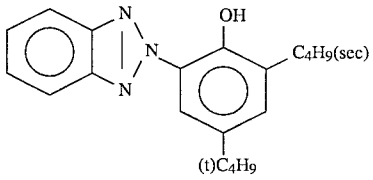
ExU-4
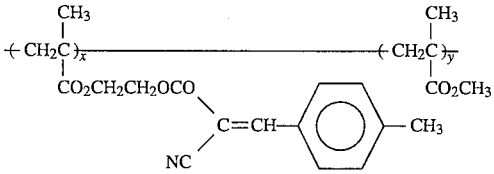
x:y = 70:30 (wt %)
ExU-5
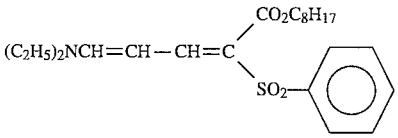
ExO-1
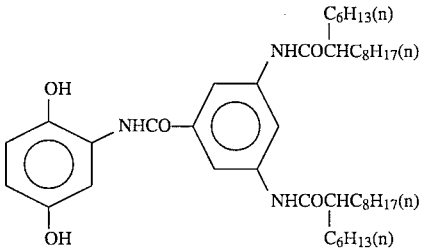
Tricresyl Phosphate
HBS-1
Di-n-butyl Phthalate
HBS-2
HBS-3
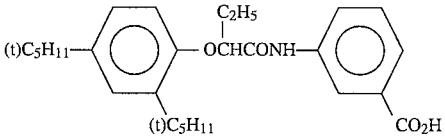

-continued
ExS-1
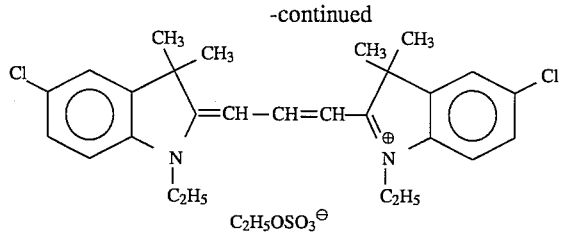
ExS-2
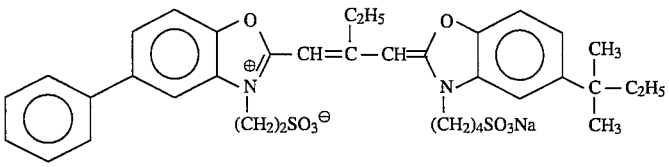
ExS-3
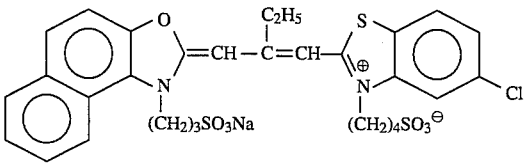
ExS-4
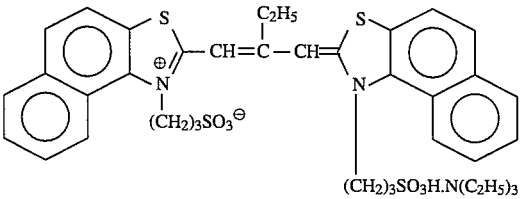
ExS-5
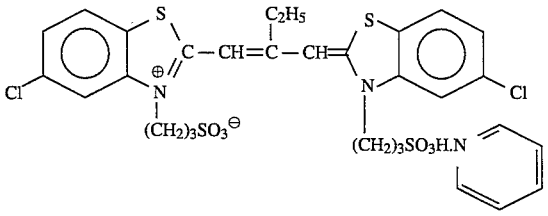
ExS-6
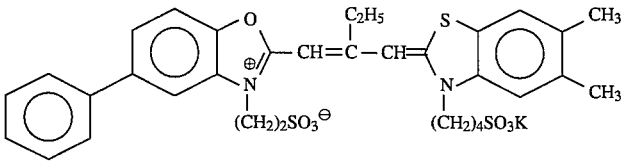
ExS-7
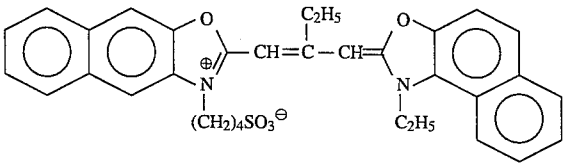
ExS-8
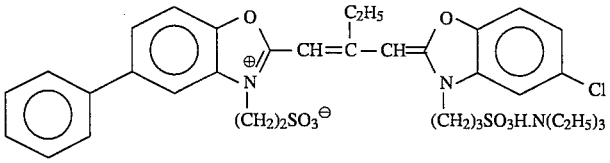
ExS-9
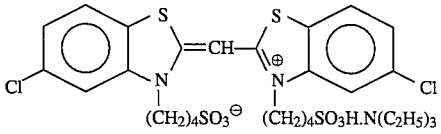

-continued
S-1
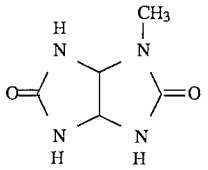
H-1
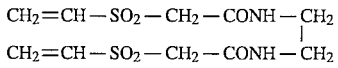
W-1
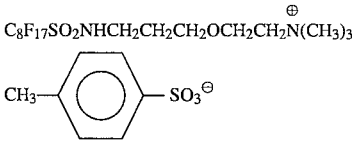
W-2
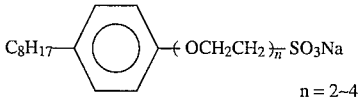
W-3
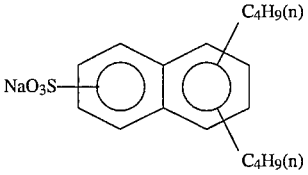
W-4
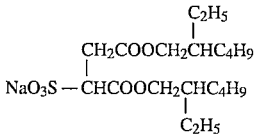
B-1
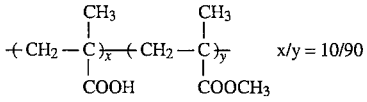
B-2
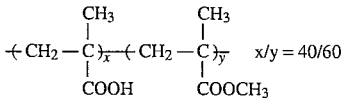
B-3
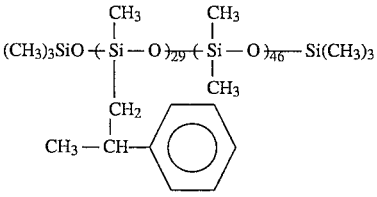
B-4
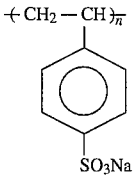
(mol. wt. about 1,000,000)
B-5
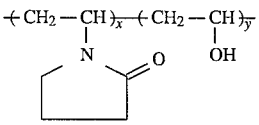
B-6
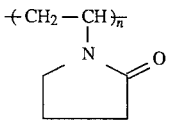
(mol. wt. about 1,000,000)
F-1
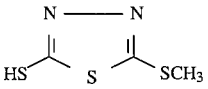
F-2
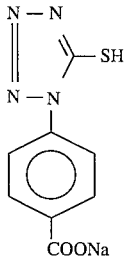
F-3
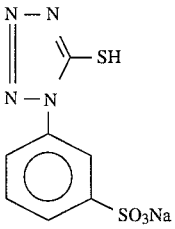
F-4
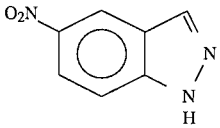
F-5
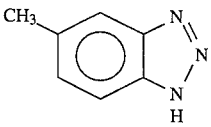
F-6
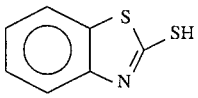

-continued

F-7

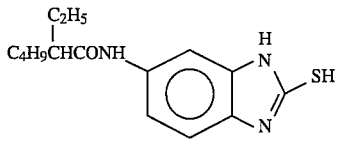

F-8

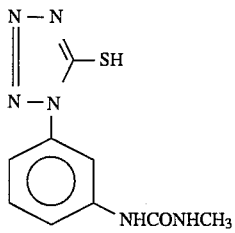

F-9

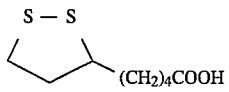

F-10

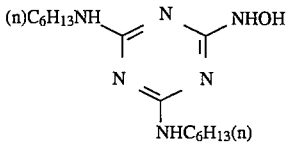

F-11

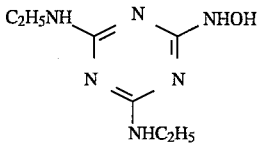

F-12

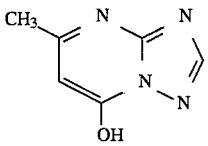

F-13

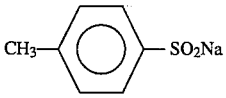

F-14

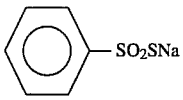

F-15

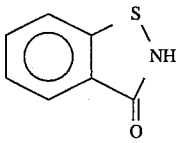

F-16

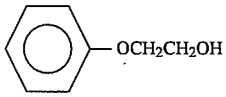

F-17

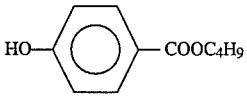

F-18

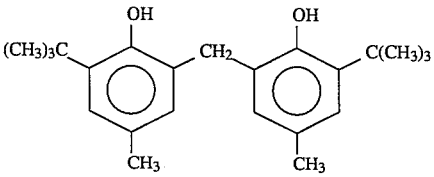

Comparative Compound SEN-1

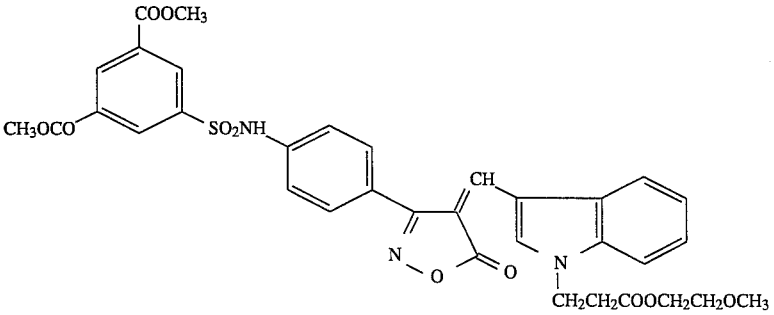

Comparative Compound SEN-2

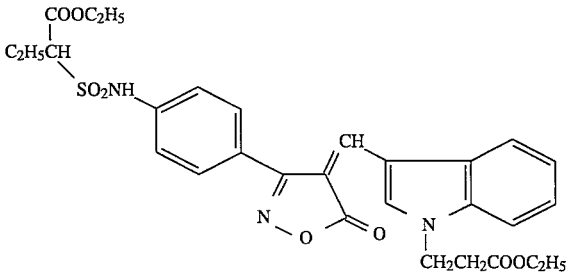

The silver halide photographic materials which are highly sensitive, sufficient in decolorizing property, small in dependency on fluctuations in processing, and excellent in keeping quality can be obtained by using the compounds of the present invention, particularly, in the yellow filter layers.

Further, the compounds of the present invention are good in stability with the lapse of time under cold storage.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having thereon at least one silver halide emulsion layer comprising at least one compound represented by formula (1)

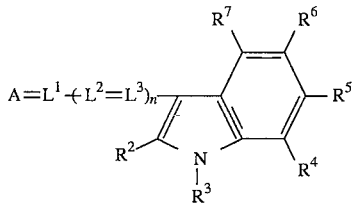

wherein A represents a cyclic or chain active methylene group; $L^1$, $L^2$ and $L^3$ each represents a methine group; n represents 0 or 1; $R^3$ represents an alkyl group containing a phosphonate as a substituent; and $R^2$, $R^4$, $R^5$, $R^6$ and $R^7$, which may be the same or different, each represents a hydrogen atom an alkyl group, an aryl group, a heterocyclic group, $—OR^{11}$, $—NR^{11}R^{12}$, $—NHCOR^{11}$, $—NHSO_2R^{11}$, $—COOR^{11}$, $—CONR^{11}R^{12}$, $—SO^2NR^{11}R^{12}$, a cyano group or a halogen atom wherein $R^{11}$ and $R^{12}$, which may be the same or different, each represents a hydrogen atom, an alkyl group, an aryl group or a heterocyclic group, and may combine together to form a 5- to 6-membered ring.

2. The silver halide photographic material as claimed in claim 1, wherein said compound represented by formula (1) is a compound represented by formula (2)

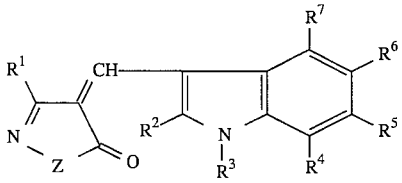

(2)

wherein $R^1$ represents a phenyl group substituted by a substituent having a dissociative proton; Z represents an oxygen atom or $—NR^{14}—$; $R^2$, $R^3$, $R^4$, $R^5$, $R^6$ and $R^7$ each has the same meaning as given in formula (1); and $R^{14}$ represents a hydrogen atom, an alkyl group, an aryl group or a heterocyclic group.

3. The silver halide photographic material as claimed in claim 1, which comprises a hydrophilic colloidal layer containing at least one compound represented by formula (1) as an oil composition and/or a polymer composition.

4. The silver halide photographic material as claimed in claim 3, which is a silver halide color photographic material, wherein said hydrophilic colloidal layer is a yellow filter layer.

5. The silver halide photographic material as claimed in claim 1, wherein said acidic nucleus represented by A represents 5-pyrazolone, isoxazolone, barbituric acid, thiobarbituric acid, rhodanine, hydantoin, thiohydantoin, oxazolidinedione, pyrazolidinedione, indandione, hydroxypyridone, pyrazolopyridone, 1,2,3,4-tetrahydroquinoline-2,4-dione, 3-oxo-2,3-dihydrobenzo[d]-thiophene-1,1-dioxide, malononitrile, benzoylacetonitrile, cyanoacetanilide or cyanoacetates.

6. The silver halide photographic material as claimed in claim 1, wherein n is 0.

7. The silver halide photographic material as claimed in claim 1, wherein said phosphonate as a substituent in $R^3$ is $—P(=O)(OR^8)(OR^9)$, in which $R^8$ and $R^9$ each represents a hydrogen atom, an alkyl group or an aryl group, and $R^8$ and $R^9$ may be the same or different, with the proviso that $R^8$ and $R^9$ are not hydrogen atoms at the same time.

8. The silver halide photographic material as claimed in claim 7, wherein $R^8$ and $R^9$ are both methyl or ethyl.

9. The silver halide photographic material as claimed in claim 1, wherein $R^3$ is 2-(dimethylphosphono)ethyl, 2-(diethylphosphono)ethyl or 2-{2-(diethylphosphono)ethoxycarbonyl}ethyl.

10. The silver halide photographic material as claimed in claim 1, wherein $R^2$, $R^4$, $R^5$, $R^6$ and $R^7$ are all hydrogen atoms.

11. The silver halide photographic material as claimed in claim 2, wherein $R^1$ is a phenyl group having sulfonamido, sulfamoyl, acylsulfamoyl or carbamoyl.

12. The silver halide photographic material as claimed in claim 2, wherein Z is an oxygen atom.

13. The silver halide photographic material as claimed in claim 1, wherein said at least one compound represented by formula (1) is used in an amount of 1 to 1,000 mg per $m^2$ of area of said photographic material, and said amount represents the total amount of compound of formula (1) present in said silver halide photographic material.

14. The silver halide photographic material as claimed in claim 1, wherein A represents a cyclic ketomethylene group or a ketomethylene group substituted by an electron withdrawing group.

15. The silver halide photographic material as claimed in claim 2, wherein $R^1$ represents a phenyl group substituted by a member selected from the group consisting of a sulfonamido group, a sulfamoyl group, an acylsulfamoyl group and a carbamoyl group.

* * * * *